US007086464B2

(12) United States Patent
Edwards et al.

(10) Patent No.: US 7,086,464 B2
(45) Date of Patent: Aug. 8, 2006

(54) WELL TESTING SYSTEM

(75) Inventors: Jeffrey Charles Edwards, Suffolk (GB); Andrew Richards, Aberdeenshire (GB)

(73) Assignee: Expro North Sea Limited, Aberdeen (GB)

( * ) Notice: Subject to any disclaimer, the term of this patent is extended or adjusted under 35 U.S.C. 154(b) by 56 days.

(21) Appl. No.: 10/398,262

(22) PCT Filed: Oct. 4, 2001

(86) PCT No.: PCT/GB01/04393

§ 371 (c)(1),
(2), (4) Date: Jun. 3, 2003

(87) PCT Pub. No.: WO02/29196

PCT Pub. Date: Apr. 11, 2002

(65) Prior Publication Data

US 2004/0094296 A1 May 20, 2004

(30) Foreign Application Priority Data

Oct. 5, 2000 (GB) ..... 00243782

(51) Int. Cl.
*E21B 7/00* (2006.01)

(52) U.S. Cl. ..... 166/250.1; 166/264

(58) Field of Classification Search ..... 166/250.01, 166/264, 336, 242.3
See application file for complete search history.

(56) References Cited

U.S. PATENT DOCUMENTS 3,646,995 A * 3/1972 Manes et al. ..... 166/336
3,762,219 A * 10/1973 Jessup ..... 73/152.23
4,691,778 A 9/1987 Pyne et al.

(Continued)

FOREIGN PATENT DOCUMENTS

WO WO 0058604 10/2000

(Continued)

*Primary Examiner*—William Neuder
(74) *Attorney, Agent, or Firm*—Gifford, Krass, Groh, Sprinkle, Anderson & Citkowski, P.C.

(57) ABSTRACT

A well testing system and well testing method is described which can be operated as a closed system with no production of hydrocarbons outside the well or gas can be separated and flared at surface giving minimal environmental impact with the liquid hydrocarbon being re-injected. This is achieved by providing a string with at least two well conduits which may be arranged in a concentric or non-concentric parallel configuration. One conduit is used to produce formation fluids to surface or to produce/store unrepresentative initial flow products and the other conduit is used to store formation fluid. The storage conduit can be filled from the top (surface) or the bottom of the well. In a preferred arrangement a valve is provided between the storage conduit and the well annulus for well pressure control, and a shut-in or test valve, which is controllable from surface, is disposed in the non-storage production conduit. A flow control valve is provided at the lower end of the string or at surface and the size of the valve opening is controllable to allow formation fluid to enter the storage string at a controlled rate, so that the formation fluid flowing time is increased to maximise the radius of investigation into the formation to a similar order of magnitude of existing production tests and extended well tests, which are typically two to three times the order of magnitude of the radius of investigation of a wireline formation test. Other aspects and embodiments of the invention are described.

28 Claims, 4 Drawing Sheets

U.S. PATENT DOCUMENTS

| | | | | |
|---|---|---|---|---|
| 5,638,904 | A | 6/1997 | Misselbrook et al. | 166/384 |
| 5,937,945 | A | 8/1999 | Bussear et al. | |
| 5,996,687 | A | 12/1999 | Pringle | |
| 6,729,398 | B1 * | 5/2004 | Ringgenberg et al. | 166/250.01 |

FOREIGN PATENT DOCUMENTS

| | | |
|---|---|---|
| WO | WO 0065199 | 11/2000 |

* cited by examiner

WELL TESTING SYSTEM

FIELD OF THE INVENTION

The present invention relates to a well testing system and to a method of conducting a well test. The invention also relates to a flow control valve for use with the well test system.

BACKGROUND OF THE INVENTION

Minimising the environmental impact of well testing has, for some time, been a major issue in the oil industry. In some areas of the world, legislation and taxation upon greenhouse gases produced can double the cost of a well test. The ability to conduct a well test without the necessity to flare the produced hydrocarbons and still obtain the quality and quantity of data required to allow formation to be evaluated correctly would significantly increase the number of tests conducted on a worldwide basis.

Traditional well test operations involves the production and disposal of hydrocarbons creating large quantities of both greenhouse and noxious emissions and the relatively high risk of pollution due to inefficient combustion of the hydrocarbons or accidental spillage.

Several different techniques have been developed to date in an attempt to minimise the environmental impact of well testing. The two techniques which are most commonly used are:

a) downhole pressure and sampling systems, such as Schlumberger's MFT, RFT and MDT tools or Baker's RCI system;

b) close chamber testing such as that developed by Halliburton and used in environmentally sensitive areas, such as the Gulf of Mexico or onshore California.

The amount of information which is obtained by downhole logging systems is limited, primarily due to small volumes which flow from the formation providing samples which can be contaminated by fluids used during the drilling wells and also due to a very small radius of investigation into the reservoir which can lead to the skin effect (formation damage created by the drilling process) having an overwhelming effect on the information obtained. One significant advantage of the aforementioned system over conventional well testing is the ability to determine the vertical permeability of the formation. The close chamber testing minimises the environmental impact of the test but, once again, due to the relatively small volumes of fluid displaced, provides limited data in terms of quality and quantity. In fact, one of the major problems associated with any type of close chamber testing has been resolution of downhole gauges. With relatively small produced volumes, the change and pressure in any normal sized reservoir is very small and until recently with the development of quartz crystal gauges, these pressure changes have been undetectable. This problem combined with the constantly changing skin and flow rate effects during the initial flow period have made evaluation of close chamber data exceedingly difficult and potentially unreliable. Indeed, a significant disadvantage of conventional close chamber systems is the very small volume of fluid which is taken from the formation due to low storage volumes which does not allow uncontaminated pressure volume temperature (PVT) samples to be obtained.

An object of the present invention is to provide an improved well test system and method of testing a well which obviates or mitigates at least one of the disadvantages of the aforementioned systems.

SUMMARY OF THE INVENTION

This is achieved by providing a string with at least two well conduits which may be a concentric or non-concentric parallel configuration. One conduit is used to produce formation fluids to surface or to produce/store unrepresentative initial flow products and the other conduit is used to store formation fluid. The storage conduit can be filled from the top (surface) or the bottom of the well. In a preferred arrangement a valve is provided between the storage conduit and the well annulus for well pressure control, and a shut-in or test valve, which is controllable from surface, is disposed in the non-storage production conduit. A flow control valve is provided at the lower end of the string or at surface and the size of the valve opening is controllable to allow formation fluid to enter the storage string at a controlled rate, so that the formation fluid flowing time is increased to maximise the radius of investigation into the formation to a similar order of magnitude of existing production tests and extended well tests, which are typically two to three times the order of magnitude of the radius of investigation of a wireline formation test. This flow rate is regulated so that the data obtained is sufficient to maintain the change in pressure above the gauge resolution leading to accurate and reliable pressure data being taken throughout the well test.

In a first embodiment of the system, the string has an inner cylindrical conduit defining a main fluid flow production bore with a test valve disposed therein, and a concentric annulus conduit surrounding the inner conduit and defining with the inner conduit, an annulus chamber which functions as the formation fluid storage volume.

In an alternative embodiment the two conduits are a main bore production conduit and a separate annulus conduit. The conduits are non-concentric and parallel. In this embodiment the storage conduit is of greater diameter than the main bore production conduit and functions as a formation fluid storage chamber. In a variation of the alternative embodiment the annulus bore may be smaller than the main bore and formation fluid may be produced via the annulus and stored in the main bore.

For both embodiments the main bore and annulus bore extend over almost the entire length of the string. In a subsea application the inner conduit and annulus conduit are coupled to respective main and annulus conduits of a subsea test tree or the like which is adapted to be disposed in a BOP stack. In a non-subsea application the inner conduit and annulus conduit are coupled to a surface or near surface BOP stack.

In the first embodiment a fluid flow control valve is disposed at the leading end of the inner conduit, and to perform a test, the valve is controlled to open very gradually and allow fluid to flow into the main bore at a very low rate and then into the annular storage chamber. This allows a hydrostatic head to stabilise with a relatively small volume produced, therefore accessing valid data relatively quickly. The system can enable a well to be produced at an appreciably lower rate than standard tests, for example 1,000–1,200 barrels per day compared to 800 approximately 1,000–1,200 barrels per day for an eight hour period with an additional flow rate period of PVT sampling, allowing a reasonable investigation radius of perhaps 100–1,000 ft. and clean representative formation fluids to be taken.

On completion of the test, the produced fluid is re-injected from the annulus storage chamber into the formation obtaining pressure transient injection data which effectively increases the reservoir information obtained. The use of a flowmeter allows the pressure transient data to be evaluated in a coherent manner when the well flows at variable rates before well kill, and the test to be repeated, if necessary. A major advantage over the conventional closed chamber testing is that the actual gas-oil ratio (GOR) is obtained.

Based on the inner conduit being a 2" or 2.375" tubing locked into wide bore of a 7" casing, the annulus bore will provide approximately 30 barrels of storage per thousand feet of well depth, that is about 300 barrels at 10,000 ft. which would be utilised for both clean-up and formation fluids.

According to a first aspect of the present invention, there is provided a well testing system for producing and storing a volume of formation fluid from a well, said well testing system comprising:

a test string having a packer for sealing the test string to casing or well bore surface:

a first well conduit extending the length of the well;

a second well conduit extending the length of the well, said first conduit and said second conduit each having a conduit top and a conduit bottom, said first flow conduit extending past the bottom of the second flow conduit, said second well conduit providing a chamber for storing formation fluid;

a first valve disposed between said conduits at or near the bottom of second conduit;

a valve coupled to top of each of said first and second conduits, at least one formation fluid pressure measuring device disposed in the formation fluid flowpath between an inlet to said first conduit and the valve at the top of said first conduit for measuring the pressure of the formation fluid.

Preferably said first valve is disposed between said storage conduit and a well annulus for providing well pressure control.

Preferably also, a test valve or a shut-in valve, controllable from surface, is provided in said first conduit above said pressure measuring device and below said first valve for measuring pressure in said first conduit when said tester valve is open or closed.

Advantageously, a variable flow valve and flowmeter is disposed in said first conduit through which formation fluid flows, said flow valve being controllable from surface to set the flow rate or formation fluid into said first conduit.

Conveniently, the variable flow valve and flowmeter is disposed near the bottom of said first conduit to facilitate immediate control for formation flow. Alternatively, the variable flow valve and flowmeter can be located at surface.

Preferably, for subsea applications, the conduits are coupled to a dual bore subsea test tree, a dual conduit riser, a fluted hanger and a surface tree. Alternatively, for land or platform-based applications, the first and second conduits are coupled to a land tree and a fluted hanger.

In one embodiment, the first conduit is a main production conduit and the second conduit is concentric with said first conduit and defines an annular storage chamber between the first and second conduits. Preferably, said first valve is a sleeve valve. Preferably also, a second sleeve valve is provided between the main bore and said annulus bore, said second sleeve valve being controllable from surface to allow formation fluid to circulate between the first conduit and the annular storage chamber.

In an alternative embodiment, the first and second conduits are non-concentric and parallel, and are coupled to a valve block for routing flow of formation fluid to the main or annulus conduits, or to circulate fluid between said parallel bore. Advantageously, a circulating sleeve valve is disposed in at least one of said first and second conduits.

Preferably also, a circulating sleeve valve is disposed between said first conduit and said second conduit and movable between an open and a closed position and controllable from surface to allow circulating fluid to be pumped from the surface through the first and second conduits to allow substantially all formation fluid to be removed back into the formation and to permit the string to pulled to the surface.

Preferably also, a temperature gauge is provided to measure the temperature of the formation fluid.

Preferably also, the flow control valve converts axial and longitudinal movement to rotary movement. Conveniently the flow control valve includes an outer mandrel which is axially movable only, said outer mandrel carrying a pin. An inner mandrel has an oblique longitudinal slot which receives the pin of the outer mandrel, the inner mandrel being constrained to move in a rotational direction only. When the outer mandrel is moved longitudinally, the pin moves along the oblique slot and causes the inner mandrel to rotate. The inner mandrel has a valve element which registers in part with an aperture in the conduit and when the apertures overlap, formation fluid outside the string can flow through the flow control valve into the main bore and then through the annulus valve into the annulus storage area during which time the formation fluid flow parameters can be measured.

The outer mandrel is controlled from surface and travels a relatively long axial distance compared to the rotational travel of the inner mandrel. Preferably, the dimensions and movements may be proportioned such that an inch of travel of the outer mandrel produces a rotational ratio movement of about 1/100th of an inch, giving very fine control over the flow control valve, allowing formation fluid to flow into the annulus storage area at a sufficiently low rate to allow data to be obtained without compromising the resolution of the gauges and allowing the well test to simulate an extended well test with a corresponding radius of investigation into the surrounding formation. Conveniently, the outer mandrel is coupled to a brushless dc motor and a gearbox with a low friction worm drive.

In an alternative embodiment, the first and second conduits are parallel and coupled together at various points throughout the length of the string being made up in sections, as is well known to persons skilled in the art. In this case, the main conduit and annular conduit fit into respective bores in a lower sub which has a valve, a main bore valve and an annulus valve in respective bores. The main bore and annular bore conduits merge into a single bore at the lower end of the sub into which a further test or shut-in valve is disposed. The sub-assembly is coupled to measurement gauges and a flow control valve as for the first embodiment.

This arrangement operates substantially identical to the concentric arrangement in that the valves are arranged such that during run-in two valves are opened, i.e. the test valve and main bore valve, to allow the first batch of formation fluid to flow into the main bore so remove the well debris. Once clear formation fluid is obtained, based on the judgement of an engineer on surface, the main bore valve is closed and the annulus valve opened to allow clear formation fluid to be stored in the annulus conduit with the flow control valve being adjusted to set the flow rate and provide the appropriate reservoir data in accordance with reservoir engineering requirements, as will be understood by a person skilled in the art.

With this embodiment there is no requirement for valves at the top end, other than in the tree, because flow is controlled from the surface.

According to a further aspect of the present invention, there is a method of performing a well test by producing and storage a volume of formation liquid, said method comprising the steps of:

running a well test string into a downhole well, said well test string having a fluid storage volume therein;

flowing formation fluid from the downhole reservoir into said test string until clean formation fluid is obtained;

flowing clean formation fluid at a controlled rate into the storage volume downhole;

measuring at least the pressure of formation fluid during said flowing of formation fluid into the storage area at said controlled rate, and re-injecting said stored formation fluid from the storage volume back into the formation.

Preferably, the method includes withdrawing the string from the formation after re-injection of the formation fluid back into the formation.

Conveniently, the method includes the step of re-circulating fluid from surface through the well string to remove substantially all formation fluid from the string prior to withdrawal of the string from the well.

Preferably, the method includes the step of operating downhole valves from surface to run a re-test without withdrawing the string to the surface by closing a test valve and opening a flow control valve to admit fluid at the same or a different flow rate to assess formation parameters.

Preferably, the method includes the step of conveying the formation fluid to surface, separating the gas from the formation fluid and storing the liquid in the downhole storage volume.

Passing the formation fluid to surface before filling the storage volume has the advantage of being able to measure the fluid flow rate at surface. Also, water can be removed and flow measurement techniques, such as positive flow displacement, can be used.

Alternatively, the formation fluid is passed to surface and the storage volume filled with formation fluid from the surface without separating the gas from the formation fluid.

In a further alternative method, the formation fluid passes through a valve to fill the storage valve without passing to surface.

According to a further aspect of the present invention, there is provided a flow control valve for controlling the flow of fluid through said valve, said flow control valve comprising a first valve housing having a first aperture therein, and a second valve housing having a second aperture therein, said second valve housing being movable relative to the first valve housing such that overlap between the apertures determines the degree of openness of the valve and the flow rate of formation fluid therethrough, said second valve housing being coupled to a rotatable element and said rotatable element being engaged with an axially movable element, the engagement being such that the axially movable element is restrained to move axially only and the engagement is such that the axial movement causes the second element to rotate.

Preferably, the engagement between the second rotatable element and the axially movable element is by a pin and slot arrangement. Conveniently, the pin is disposed on the axially movable element and the slot is disposed on the rotatable element. Alternatively, the pin may be disposed on the rotatable element and the slot on the axially movable element.

Preferably, the axially movable element is moved in response to a force supplied via an electric motor and a gear drive.

Conveniently also, a relatively large axial movement produces a small rotational movement such that very fine control of the valve aperture is obtained to control fluid flow through said valve.

BRIEF DESCRIPTION OF THE DRAWINGS

These and other aspects of the present invention will become apparent from the following description, when taken in combination with the accompanying drawings, in which.

DETAILED DESCRIPTION OF THE PREFERRED EMBODIMENTS

Figure 1:
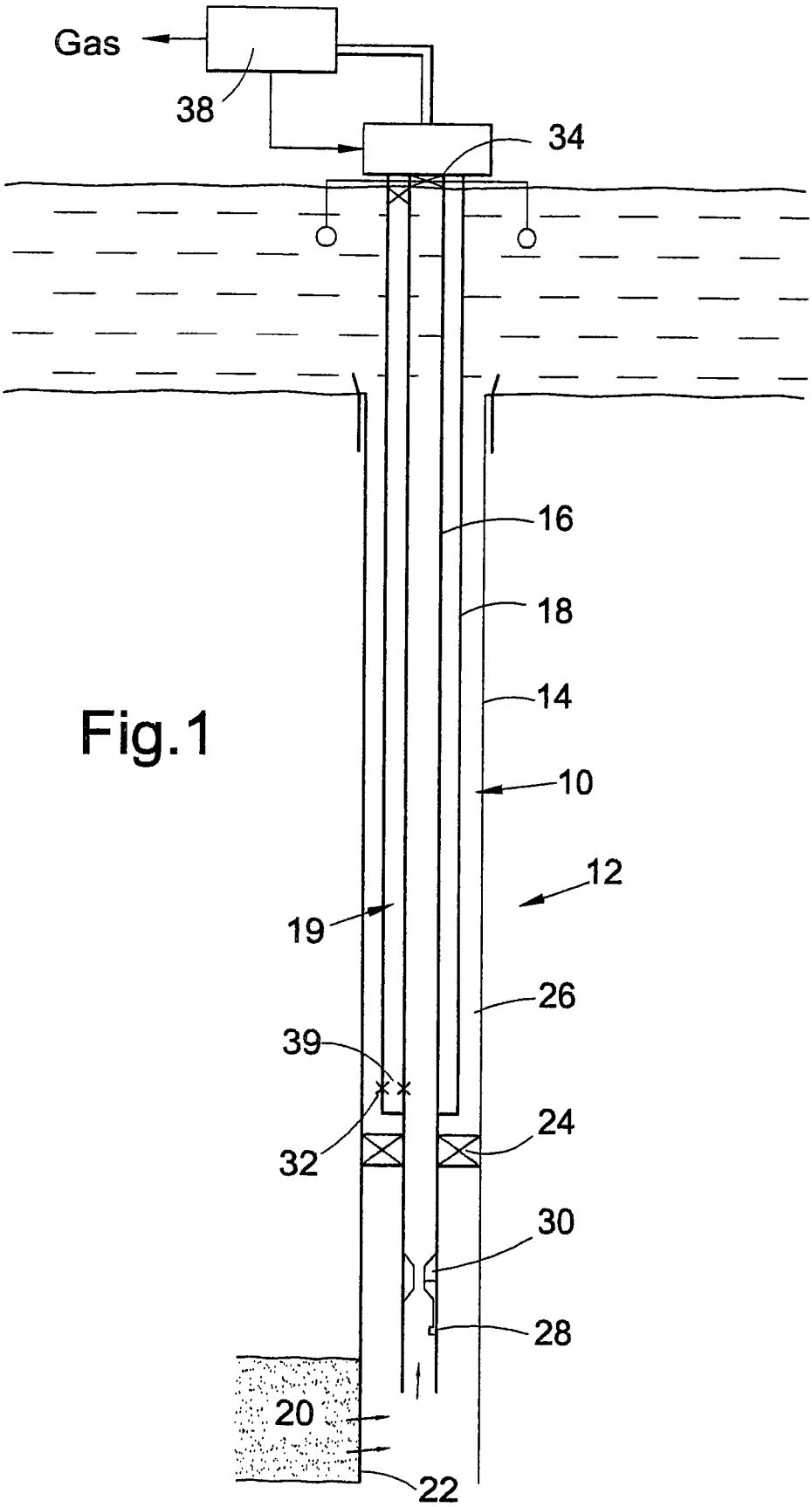
FIG. 1 is a diagrammatic view of a low environmental impact well test system in accordance with a first embodiment of the present invention.

Reference is first made to FIG. 1 of the drawings which depicts a low environmental impact test string 10 disposed in a subsea well 12 which has a casing 14. The term 'string' is used to denote a plurality of tubular elements which are coupled together at surface and fed downhole to create a structure of continuous conduits through which fluid can flow between the surface and the downhole formations. The test string 10 has an inner main bore conduit 16 and a concentric outer conduit 18 defining an annular formation fluid storage volume 19 therebetween. The inner conduit extends to the formation fluid producing zone 20 at sand face 22. A packer 24 seals the main bore conduit 16 to the casing 14 and creates a well annulus 26 between the conduit 18 and casing 14. Disposed in the main bore 16 is a pressure measuring device 28 and a flowmeter 30 for measuring the pressure of formation fluid as will be described.

A sleeve valve 32 is disposed in conduit 18 and the sleeve valve 32 can be opened/closed from the surface to provide well pressure control as will be understood by a man of ordinary skill in the art. A valve 34 is disposed at the top of the conduit 16 and this valve can be controlled from surface to allow clean formation fluid to be passed to a separator 38 which separates gas from the liquid and liquid formation fluid is conveyed to annular storage volume 19. The separated gas is flared off as it is a relatively small amount. A sleeve valve 39 may also be disposed at the lower end between inner conduit 16 and outer conduit 18. This valve is also controllable from the surface to allow formation fluid to enter the annulus 19 and to permit stored fluid to be removed from the annulus back through the inner conduit 16 and into the formation 20. This is achieved by pumping mud from surface into the annulus 19 and squeezing the formation fluid out and then recirculating the mud through the main bore and annulus until a consistent weight is obtained.

Figure 2A:
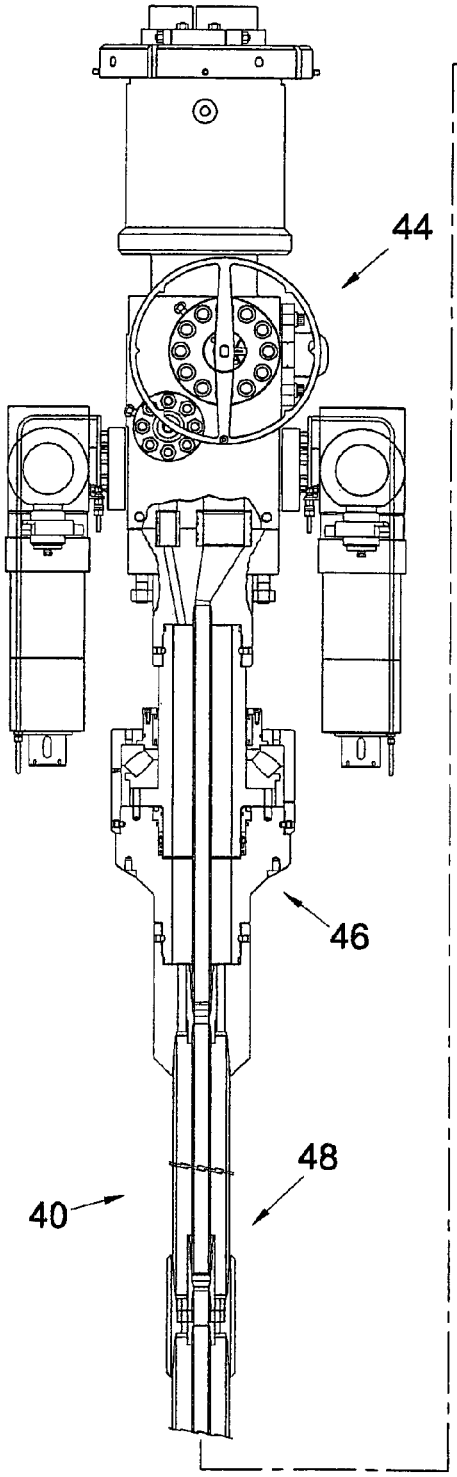
FIGS. 2*a, b, c, d, e* and *f* depict longitudinal sectional views through the principal parts of a string of a low impact well test system in accordance with the first embodiment of the present invention.
Figure 2B:
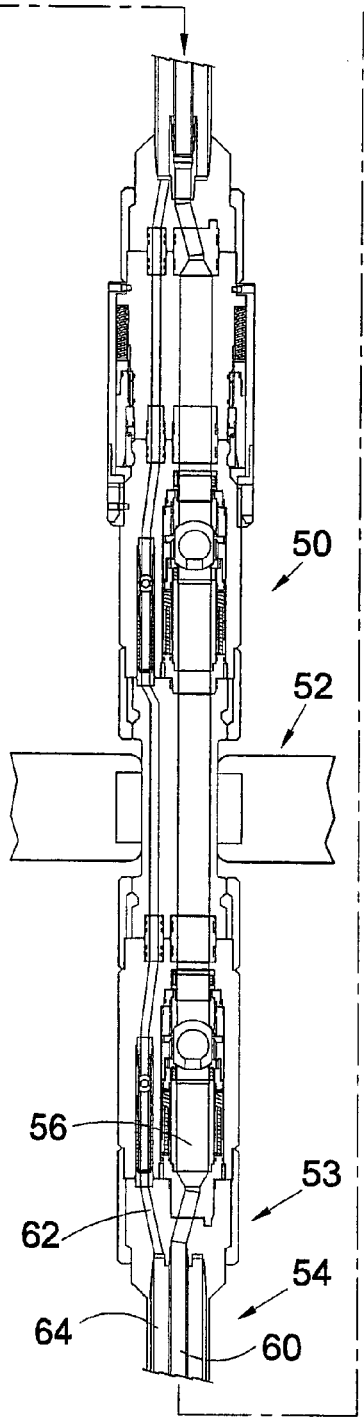
Figure 2C:
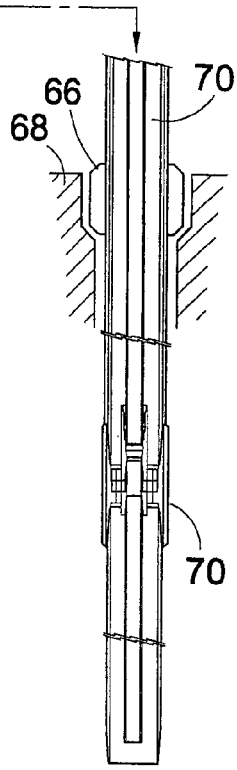
Figures 2D, 2E, 2F:
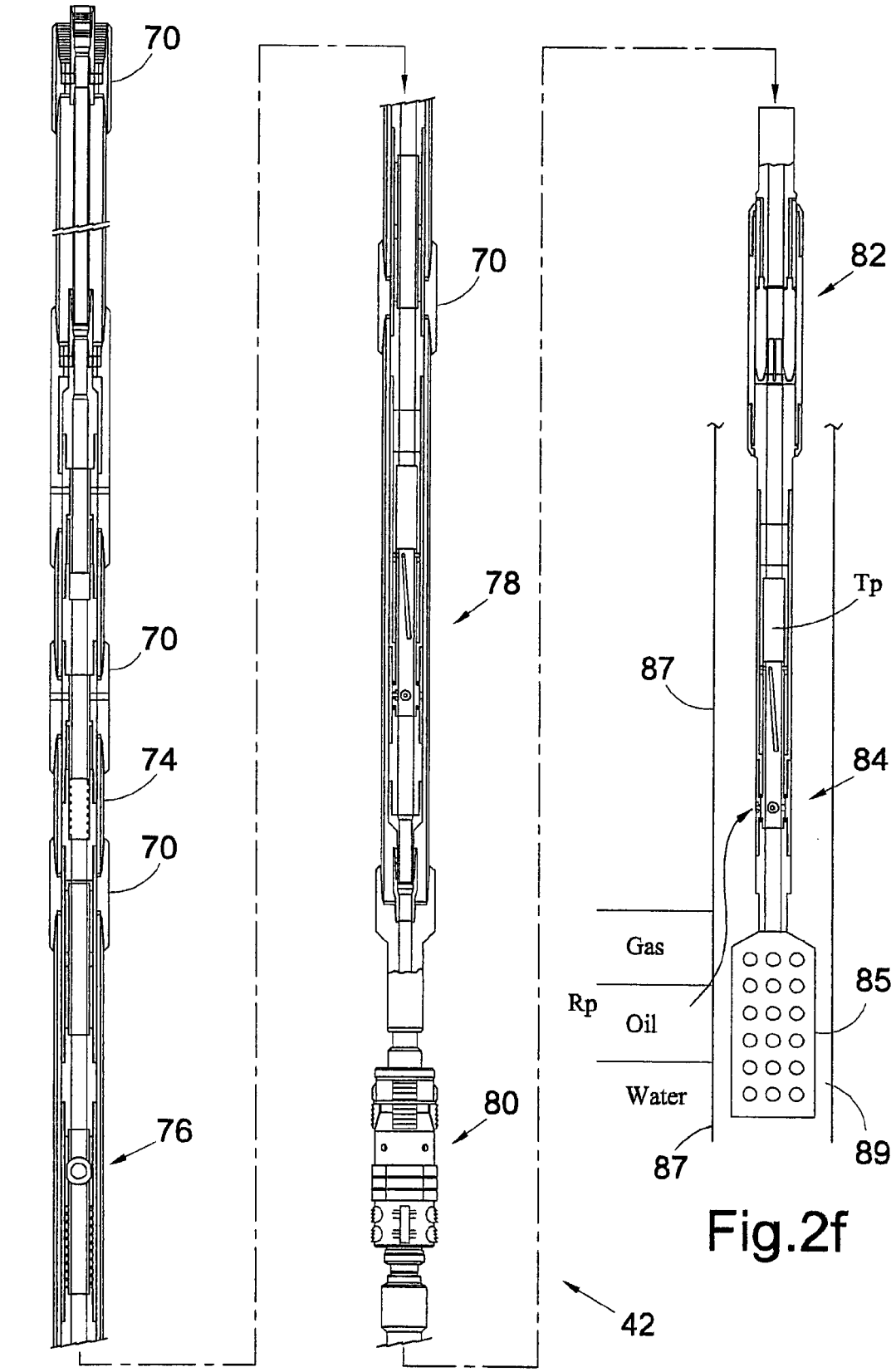

Reference is now made to FIGS. 2*a*–2*f* of the drawings which depicts in more detail the entire well string of a low impact well testing system shown in FIG. 1. FIGS. 2*a*–2*c* depict the upper string 40 of the low impact well test system which is essentially everything down to a fluted hanger and FIGS. 2*d*–2*f* depict essentially all the parts of the lower string 42 which are located within the well.

The upper well string 40 consists of, in the embodiment shown, a 5"×2" surface tree 44 which is coupled to a 7" swivel 46 which, in turn, is coupled to a concentric riser 48. The concentric riser 48 is coupled to a 4"×1" subsea test tree 50 which has a circumferential portion for receiving pipe rams 52 of a BOP test tree (not shown in the interests of clarity). The lower part of the test tree 52 is coupled at its end 53 to the top of concentric tubing 54 such that the main bore 56 of the test tree is coupled to a main conduit 60 of the concentric tubing 54 and the annulus 62 of the test tree is coupled to an annulus conduit 64 for storing formation fluid from the well test, as will be later described in detail.

The concentric tubing string 54 carries a fluted (ported) hanger 66 for retaining the string in hanger 68 which is disposed in the wellhead (not shown in the interests of clarity).

The string consists of a large number of concentric tubing sections 54 which are coupled together throughout the length of the string by concentric pipe connectors, generally indicated by reference numeral 70, which allow the main bore conduit 60 and the annulus conduit 64 to be continuous throughout the length of the string. For a string which can be 10,000 ft. long, there may about 300 concentric tubing sections coupled together by the pipe connector 40.

At the lower end of the well, the lower string 42 is disposed. Starting from FIG. 2*d*, it will be seen that the lower string 42 has a first circulating sleeve 72 which is, in turn, coupled to a selective circulating sleeve 74. The string continues with a connector 70 which is coupled to a test valve 76 and upstream of the tester valve is an electric annulus tubing selector sleeve 70. The operation of sleeves 72 and 74, test valve 76 and annulus/tubing selector sleeve 78 will be later described in detail during the description of the operation of the well test system.

Upstream of the selector sleeve 78 is the packer 80 which, in turn, is coupled to an pressure and temperature gauge carrier 82 which is coupled to a flow control valve, generally indicated by reference numeral 84. The packer seals the well string to casing 87. A formation perforator 85, provided by a tubing conveyed gun, is coupled to the end of the flow control valve 84 for perforating casing 87 and allowing formation fluid to flow into well bore 89.

The lower string shown in FIGS. 2*d*–*f* is the made-up arrangement. Once the string is run into the well, the test valve 76 is open so that the first batch of formation fluid flows into the main conduit 60 to remove any debris and the like which may have accumulated around the formation. Once this occurs, this allows recording of the fluid pressure and temperature in the main bore. Once an indication of "clean" formation fluid is obtained, which is based on the judgement of an engineer on surface, in accordance with his analysis of pressure and temperature parameters, the test valve 76 is then shut. This causes a pressure build up at the formation and this pressure is measured by gauges in carrier 82. The annulus tubing selector sleeve 78 is then opened to allow formation fluid to flow from the main conduit bore 60 into the outer annulus 64. This fluid is deemed to be clean formation fluid and the rate of flow prescribed by the flow control valve 84, the detailed operation of which will be later described, provides the appropriate reservoir data in accordance with reservoir engineering requirements which can be analysed by a person of skill in the art. The flow control valve 84 can be adjusted from surface to set the flow parameters to provide specific data requirements.

The volume of the annulus for formation fluid is known and the flow rate of formation fluid is also known for the particular valve position. Once a suitable volume of fluid has been produced into the annulus volume so that it is effectively full, the annulus tubing selector sleeve 78 is then closed, which causes a further build up of formation pressure during which data which has already been recovered, can be analysed.

Following analysis of the data, the well can be re-tested or the well test abandoned. A similar procedure is used for re-test or well abandonment. In either case, the annular selector sleeve valve 78 is opened and the flow control valve 84 is fully opened and water or other fluid, such as mud, is pumped down from the surface through the annulus to force the stored formation fluid back from the annulus 64 back into the main bore 60 and then back into the formation. The annulus/tubing selector sleeve 78 is then shut and the test valve 76 opened and the water or mud is then pumped down the main bore to expunge any residual formation fluid from the main bore 30. Once this is done, the test can be repeated at a different flow rate, if required, to provide a further set of formation data.

In order to pull the strings 40,42 from the well, the circulating sleeve 72 is opened and fluid is pumped through the tool from the surface down through the main bore 60 and up through the annulus bore 64. After this done and the circulating fluid is deemed to be consistent, formation fluid is effectively expunged from the string, although there may be some residual formation fluid between the selector sleeve and the tester valve and the string can then be pulled to the surface.

The flow control valve 84 is adjustable from surface so that formation fluid ingress into the annulus storage chamber can be at a very low rate so that the well test system effectively simulates an extended well test, allowing a large amount of data to be obtained for little total hydrocarbon production by using existing quartz crystal gauges so that the effective radius of investigation of the formation obtained from the test is comparable to that of an well test which is perhaps two or three orders of magnitude flow volume greater than existing closed systems.

Figure 3:
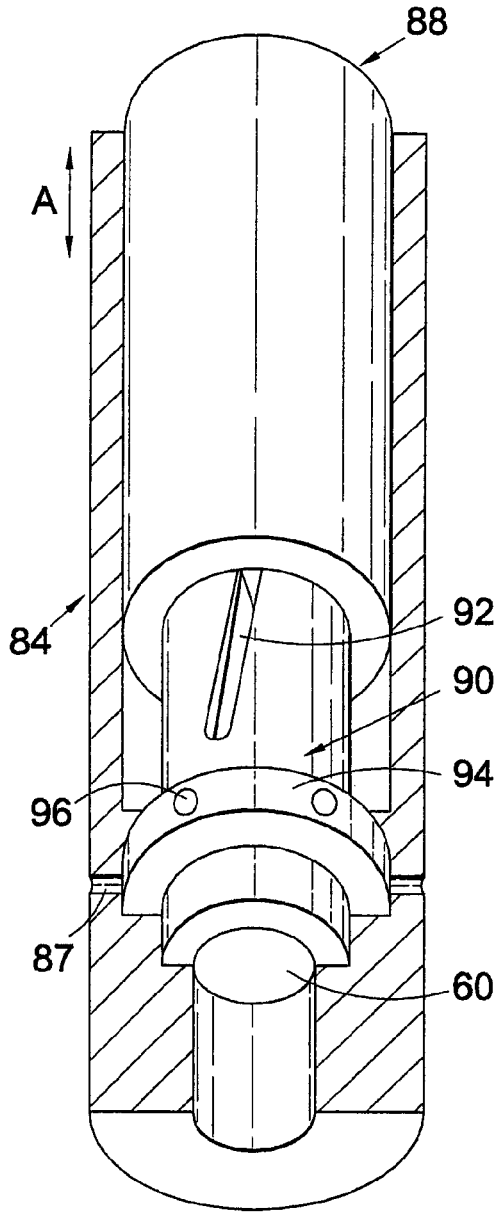
FIG. 3 is an enlarged partly sectioned view of a flow control valve used in the well string of FIG. 1.

Reference is now made to FIG. 3 of the drawings which depicts an enlarged and partly broken away view of the flow control valve 84 depicted in FIG. 2*f*. The flow control valve 84 is designed to convert a relatively large axial movement into a relatively small rotary movement so as to provide fine control of the valve opening to allow formation fluid to flow into the main bore 60 of the lower string at a carefully controlled low flow rate. The main conduit has an aperture 87 therein through which formation fluid must pass to enter the valve. Within the housing is first outer cylindrical mandrel, generally indicated by reference numeral 88, which carries a pin (not shown in the interests of clarity). Outer mandrel 88 is constrained to move in a longitudinal axial direction, indicated by arrows A. Within the outer mandrel 88 is an inner mandrel 90 which carries an oblique longitudinal slot 92 for receiving the pin of the outer mandrel 88. The lower mandrel 90 carries a valve sleeve 94 which has an aperture 96 substantially the same size as aperture 87.

When the apertures 87,96 are aligned, there is full aperture fluid flow from outside the string to the inner bore 60. When the apertures are completely out of alignment, there is no flow from the formation to the bore 60. Between these extremes, the aperture allows formation fluid to flow into the main bore at a controlled rate. The outer mandrel 88 is coupled to a brushless dc motor and gearbox via a friction worm drive (not shown in the interests of clarity) which moves the outer mandrel in the direction of arrows A. In response to axial movement of the outer mandrel, the pin engages slot 92 and, as the mandrel 88 travels axially, it causes the inner mandrel 90 to rotate. Apertures 87,96 are adjusted and movement of the inner mandrel causes the alignment of the apertures 87,96 to vary, thus affecting the size of the fluid passage and flow rate from the formation into the main bore and annular storage area. The flow control valve is designed such that a relatively long axial movement results in a relatively short or small rotary movement. For example, if the axial movement is 36", then the rotary movement may only be ½", such that every axial inch of movement results in a 1/72nd of an inch of rotary movement, giving fine control of the valve aperture and the flow formation fluid into the annular storage area. This provides careful control of the flow rate and, accordingly, allows a relatively large amount of data to be extracted by pressure and temperature measurement for example, such that the test is deemed to provide effective approximation to an extended well test with a corresponding large radius of investigation because of the relatively long time which the small volume of formation fluid takes to flow into the annular storage area.

The electric annulus tubing selector sleeve 78 may be of the same construction as the flow control valve 84 and controlled by a similar motor gearbox and drive arrangement. Alternatively, it could be a one-shot valve.

Figure 4:
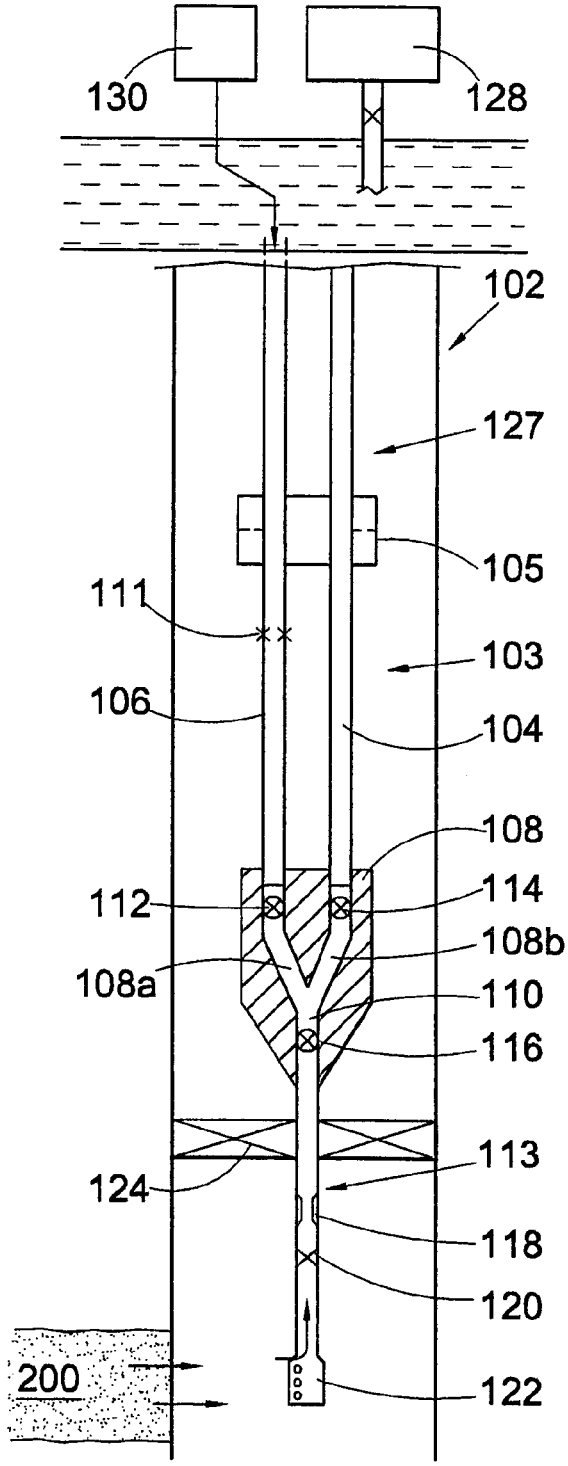
FIG. 4 depicts part of a low environmental impact well test string using first and second parallel non-concentric conduits in accordance with a second embodiment of the present invention.

Reference is now made to FIG. 4 of the drawings which depicts a test string 100 in accordance with an alternative embodiment of the invention shown disposed within casing 102. The drill string is made up of sections 103 fastened together by coupling elements 105. In this embodiment, it will be seen there is a main conduit 104 and a larger annulus conduit 106, which provides formation fluid storage volume, both of which are connected to valve block 108. Within the valve block 108 are two conduits 108*a*,108*b* which merge into a single conduit 110 at the upstream end of the valve block. A circulating sleeve valve 111 is disposed in annulus conduit 106. A similar sleeve valve could be disposed in the main bore conduit instead of, or as well as, sleeve valve 111. Each of the conduits 108*a*,108*b* and 1100 has a respective valve 112,114,116, typically a ball valve or flapper valve, able to hold pressure from below therein, each valve being controllable from surface. The conduit 110 is connected to a main bore conduit 112 which, in turn, is connected to a similar lower assembly consisting of pressure and temperature gauges and flowmeter 118, a flow control valve 120 and a tubing or wireline conveyed perforator 122, similar to those shown in FIG. 2*f* of the drawings. A packer 124 is disposed between conduit 110 and casing 126 to create a well annulus 129.

In use, once the casing 126is perforated, formation fluid hydrocarbons (plus water) from formation 200 flow up through the flow control valve 120 to the valve block 108 at a rate which is controlled via the flow control valve, as previously described. Valves 114 and 116 are open so that the initial volume of formation fluid and debris flow up through the main conduit 104. Valve 112 is closed. In this case, the formation fluid, including gas, is produced to the surface where it is passed through a surface separator system, generally indicated by reference numeral 128, and is then re-injected via a pump and valve arrangement 130 into the annulus conduit 106 so that the annulus conduit fills up with clean formation fluid. This process is repeated until the annulus conduit 106 is filled during which time formation pressure is monitored as described above with reference to the first embodiment. Formation fluid temperature can also be monitored as well as the pressure and any other formation parameters by the downhole gauge system. The separated gas is flared off at surface.

Once the annulus conduit 106 is filled and the formation data obtained is complete, it is then necessary to remove the stored formation fluid from the annulus conduit 106 and re-inject it back into the formation. To achieve this the flow control valve 120 is actuated to a fully open position and valves 112 and 116 are actuated to an open position. The rate of re-injection of fluid through valves 112,116 and the flow control valve 120 is governed by the pumps at surface. Re-injection is obtained by flowing water or mud or the like through the annulus conduit 106. After the stored formation fluid is re-injected, valve 112 is closed and valve 114 is opened and water or mud can be used to re-inject the initial formation fluid and debris back through the valves 114,116 and the flow control valve 120 back into the formation. Once this has been completed, valve 116 can be closed, valves 112,114 open and mud circulated through the main and annulus bores and then the string can be withdrawn or the flow control valve 120 re-set for carrying out a further test at the same or a different flow rate to give additional formation data.

The string shown in FIG. 4 may be used to convey the formation fluid to surface through the main production bore and then receive the formation fluid, with or without separation of the component fluids at low pressure into the annulus conduit so that the annulus conduit stores the formation fluid. Alternatively, once clean formation fluid is obtained, using an indication as described above by an experienced operator at surface, valve 114 can be closed and valve 112 opened so that the clean formation fluid can enter annulus conduit 106 from the bottom. Formation data can be obtained in the same way as described above and after the annulus conduit 106 is filled, the stored formation fluid can also be re-injected as described above by opening valves 112,116 and fully opening the flow control valve 120.

Various modifications may be made to the embodiments hereinbefore described without departing from the scope of the invention. For example, the types of pressure retaining valves which are used in each of the embodiments may be ball valves or flapper valves or any other suitable valve which can hold pressure from below. The numbers and types of gauges used to measure pressure and temperature may be varied depending on data requirements. More than one pressure gauge and more than one temperature gauge may be provided. The location of the temperature and pressure gauges is not critical but should be as close to the reservoir/formation as possible and the gauges could be placed in a different position in the string, for example, in the annulus above the annulus selector valve 78 in FIG. 2*e* or above annulus valve in FIG. 3. The perforator 85 can either be a tubing or a wireline conveyed gun to perforate the casing and allow the formation fluid to flow into the main bore.

With each embodiment a second packer can be included to enable formation fluid to be pumped back into a different formation, either after storage or directly. The formation fluid could be pumped back into a different formation in the same well, or even to a different well.

The principal advantage of this system is that it gives fine control of the flow rate into the annulus storage valve to provide better flow data with a smaller production hydrocarbon volume. This well testing system and method maximises the radius of investigation for existing gauge resolution and provides more accurate and reliable data for assessing well parameters. The system can be operated such that it is in effect a closed system with no production of hydrocarbons outside the well or gas can be separated and flared at surface giving minimal environmental impact with the liquid hydrocarbon being re-injected. The various embodiments of the invention allow for the selection of a particular system to meet specific well requirements and the use of a fine adjustment flow control valve means that flow rates into the annulus storage area can be finely controlled, such that accurate formation data can be obtained both for temperature and pressure.

A further advantage of this arrangement is obtained by utilizing a dual packer assembly to isolate a specific zone of interest and enable testing to be conducted without the requirement to case the test section prior to testing operations.

Use of the system in conjunction with a dual packer arrangement also enables the well to continuously produce, via the main bore conduit, to a surface production facility. The reservoir fluids separated by the production facility and the unwanted fluids, i.e. gas, oil or water are re-injected via the external bore and disposed of into an isolated zone, thus enabling all the commercial and data benefits of an extended well test to be obtained without emissions. The removal of the requirement to case the well to the producing zones, reduces well production costs substantially for each well.

The invention claimed is:

1. A well testing system for producing and storing a volume of formation fluid from a well, said well testing system comprising:

a test string having a packer for sealing a test string to a well bore surface:

a first well conduit extending the length of the well and having an inlet;

a second well conduit extending the length of the well, said first conduit and said second conduit each having a conduit top and a conduit bottom, said first flow conduit extending past the bottom of the second flow conduit, said second well conduit providing a chamber for storing formation fluid;

a first valve disposed between said first and second conduits proximate the bottom of the second conduit;

a valve coupled to the top of each of said first and second conduits; and at least one formation fluid pressure measuring device disposed in a flowpath of said formation fluid between said inlet to said first conduit and the valve at the top of said first conduit for measuring the pressure of the formation fluid.

2. A system as claimed in claim 1 further comprising a well annulus, and a second valve disposed between said second conduit and said well annulus for providing well pressure control.

3. A system as claimed in claim 1 further comprising a tester valve controllable from the surface disposed in said first conduit above said pressure measuring device and below said first valve for measuring pressure in said first conduit when said tester valve is open or closed.

4. A system as claimed in claim 1 further comprising a variable flow valve and flowmeter disposed in said first conduit through which formation fluid flows, said flow valve being controllable from the surface to set the flow rate of formation fluid into said first conduit.

5. A system as claimed in claim 4 wherein the variable flow valve and flowmeter are disposed near the bottom of said first conduit to facilitate immediate control for normal flow.

6. A system as claimed in claim 4 wherein the variable flow valve and flowmeter are located at the surface.

7. A system as claimed in claim 1 wherein, for subsea applications, the first and second conduits are coupled to a dual bore subsea test tree, a dual conduit riser, a fluted hanger and a surface tree.

8. A system as claimed in claim 1 wherein for land or platform-based applications, the first and second conduits are coupled to a land tree and fluted hanger.

9. A system as claimed in claim 1 wherein the second conduit is concentric with said first conduit and defines an annular storage chamber between the first and second conduits.

10. A system as claimed in claim 1, wherein said first valve is a sleeve valve.

11. A system as claimed in claim 9 further comprising a second valve disposed between the first bore and the second bore, said second valve being controllable from surface to allow formation fluid to circulate between the first conduit and the annular storage chamber.

12. A system as claimed in claim 1 wherein the first and second conduits are non-concentric and parallel, and are coupled to a valve block for routing flow of formation fluid to the first or second conduits circulating fluid between said parallel conduits.

13. A system as claimed in claim 1 wherein said first valve is a circulating sleeve valve.

14. A system as claimed in claim 1 wherein said first valve is a circulating sleeve valve disposed between said first conduit and said second conduit and is movable between an open and a closed position and controllable from the surface to allow circulating fluid to be pumped fromthe surface through the first and second conduits to allow substantially all formation fluid to be removed back into the formation and to permit the string to pulled to the surface.

15. A system as claimed in claim 1 further comprising a temperature gauge to measure the temperature of the formation fluid.

16. A system as claimed in claim 1 wherein the flow control valve converts axial and longitudinal movement to rotary movement.

17. A system as claimed in claim 16 wherein the flow control valve further includes: an outer mandrel axially movable only and carrying a pin; and an inner mandrel having an oblique longitudinal slot configured to receive the pin of the outer mandrel, the inner mandrel being constrained to move in a rotational direction only such that when the outer mandrel is moved longitudinally, the pin moves along the oblique slot and causes the inner mandrel to rotate, said inner mandrel having an apertured valve element which registers in part with an aperture in the conduit when the apertures overlap, and formation fluid outside the string flows through the flow control valve into the first bore and then through the second valve into the storage chamber during which time the formation fluid flow parameters can be measured.

18. A system as claimed in claim 17 wherein the outer mandrel is controlled from the surface and travels a relatively long axial distance compared to rotational travel distance of the inner mandrel.

19. A system as claimed in claim 18 wherein an inch of travel of the outer mandrel produces a rotational travel of the inner mandrel of about 1/1000th of an inch, giving very fine control over the flow control valve, such that formation fluid is allowed to flow into the storage chamber at a sufficiently low rate to allow data to be obtained without compromising the resolution of the gauges and allowing the well test to simulate an extended well test with a corresponding radius of investigation into the surrounding formation.

20. A system as claimed in claim 19 wherein the outer mandrel is coupled to a brushless dc motor and a gearbox with a low friction worm drive.

21. A system as claimed in claim 1 wherein the first and second conduits are parallel and coupled together at various points throughout the length of the string wherein the first conduit and second conduit fit into respective bores in a lower sub which has a valve, a main bore valve and an annulus valve in respective bores, said first bore and said second bore conduits merging into a single bore at a lower end of the sub in which a second tester is disposed.

22. A method of performing a well test by producing and storage a volume of formation liquid, said method comprising the steps of:

running a well test string into a downhole well, said well test string having a fluid storage volume therein;

flowing formation fluid from the downhole reservoir into said test string until clean formation fluid is obtained;

flowing clean formation fluid at a controlled rate into the storage volume downhole;

measuring at least the pressure of formation fluid during said flowing of formation fluid into the storage area at said controlled rate, and re-injecting said stored formation fluid from the storage volume back into the formation.

23. A method as claimed in claim 22 wherein the method includes the further step of withdrawing the string from the formation after re-injection of the formation fluid back into the formation.

24. A method as claimed in claim 22 wherein the method includes the further step of re-circulating fluid from the surface through the well string to remove substantially all formation fluid from the string prior to withdrawal of the string from the well.

25. A method as claimed in claim 22 wherein the method includes the further step of operating downhole valves from the surface to run a re-test without withdrawing the string to the surface by closing a test valve and opening a flow control valve to admit fluid to assess formation parameters.

26. A method as claimed in 22 wherein the method includes the further steps of conveying the formation fluid to the surface, separating the gas from the formation fluid and storing the liquid in the fluid storage volume.

27. A method as claimed in claim 22 including the further steps of passing the formation fluid to the surface and filling the storage volume with formation fluid from the surface without separating the gas from the formation fluid.

28. A method as claimed in claim 22 including the further step of passing the formation fluid through a valve to fill the storage valve without passing to the surface.

* * * * *